US006183111B1

(12) United States Patent
Wang

(10) Patent No.: US 6,183,111 B1
(45) Date of Patent: Feb. 6, 2001

(54) FIGURATIVE STRUCTURE FOR CLAMPING A DECORATIVE LAMP STRING

(76) Inventor: Chih-Tung Wang, P.O. Box 96-405, Taipei 106 (TW)

( * ) Notice: Under 35 U.S.C. 154(b), the term of this patent shall be extended for 0 days.

(21) Appl. No.: 09/313,514

(22) Filed: May 17, 1999

(51) Int. Cl.[7] ..... F21V 21/00
(52) U.S. Cl. ..... 362/249; 362/806; 362/252
(58) Field of Search ..... 362/219, 252, 362/806, 396

(56) References Cited

U.S. PATENT DOCUMENTS

| | | | | |
|---|---|---|---|---|
| 5,526,246 | | 6/1996 | Liou | 362/249 |
| 5,727,872 | | 3/1998 | Liou | 362/249 |
| 5,993,025 | * | 11/1999 | Huang | 362/249 |
| 6,017,134 | * | 1/2000 | Wang | 362/249 |
| 6,019,494 | * | 2/2000 | Lee | 362/249 |
| 6,030,096 | * | 2/2000 | Lin | 362/249 |
| 6,056,418 | * | 5/2000 | Hsu | 362/249 |
| 6,062,707 | * | 5/2000 | Wang | 362/249 |

* cited by examiner

*Primary Examiner*—Thomas M. Sember
(74) *Attorney, Agent, or Firm*—Dougherty & Troxell

(57) ABSTRACT

A figurative structure for clamping a decorative lamp string, having a lamp-mounting frame with a plurality of fastening bases. Each fastening base has a hollow portion for mounting a socket assembly of the lamp string, every two adjacent fastening bases being connected together by means of connecting arm plates. Only a given part of each socket assembly of the lamp string mounted on the lamp-mounting frame is covered by the positioning plates or hooks 20. Thus, the front or rear side of the lamp-mounting frame can show the figurative structure formed with the socket assemblies to enable the bulbs on the fastening bases to be seen clearly. The figurative structure formed with the lamp-mounting frame can be shown completely by means of the winked bulbs.

2 Claims, 4 Drawing Sheets

FIGURATIVE STRUCTURE FOR CLAMPING A DECORATIVE LAMP STRING

BACKGROUND OF THE INVENTION

1. Field of the Invention

This invention relates to a decorative lamp, and particularly to a figurative structure for clamping a decorative lamp string.

2. Description of the Prior Art

In the conventional decorative lamp string for Christmas season, a plurality of sockets are mounted therein by using two or more than two power wires twisted together to connect such sockets in series; such a lamp string is subject to swinging or hanging in the air because of the sockets thereof not being fastened in place.

In the conventional decorative lamp string for a given festival, the figurative lamp-mounting frame is usually made of a metal, on which a plurality of socket assemblies connected in series with twisted power wires are mounted thereon. The power wires and the figurative lamp-mounting frame are usually not fastened together; as a result, the lamp string and the lamp-mounting frame are subject to separating from each other. Some of such lamp strings may be fastened in place with fastening cord; however, the sockets and the power wires are also subject to swinging and hanging in the air.

In the conventional decorative lamp string for Christmas season, please reference the U.S. Pat. No. 4,802,072, it is a direction fixture for decorative lamp series comprising a socket for a bulb, wires connected to said socket and a retaining ring attached to said socket, said retaining ring being provided with a notch extending longitudinally of the socket with the wires that are connected to said socket being positioned and retained in said socket so as to fixed said socket in a desired orientation and wherein said retaining ring has an outer face which is in registry with an end rim of said socket. In the aforesaid invention, the socket assemblies and the power wires are fastened in place with fastening slips, but the socket assemblies and the power wires appear to be out of order; therefore, the lamp string has to be fastened to a lamp-mounting frame with fastening cords.

In another conventional lamp string for Christmas season, please reference the U.S. Pat. No. 5,526,246, the front part of the figurative structure is provided with a fastening base, which is furnished with a plurality of hooks for clamping sockets respectively; then, the sockets are fastened to the figurative structure. When the bulbs wink, the figurative structure will be shown vividly. The back of the figurative structure is provided with a connection plate; as a result, such figurative structure can only be used for one-side decoration.

In still another conventional lamp string for Christmas season, such as U.S. Pat. No. 5,727,872, the bulb-plugging end of the socket assembly has two curved surfaces on both sides thereof, and one side thereof has two symmetrical arm plates extended out; the tail ends of such arm plates have two curved hooks respectively; the inner surface of the hooks each have a curved surface to fit to the figurative lamp-mounting frame. The outer ends of the two hooks form into an opening; each socket assembly has two arm plates to form into an opening so as to click to the metal rod of the figurative lamp-mounting frame, i.e., to have the socket assembly clamped to the metal rod of the figurative lamp-mounting frame.

SUMMARY OF THE INVENTION

The prime object of the present invention is to provide a figurative lamp-mounting frame, in which every lighting point is furnished with a fastening base, and each fastening base has an open end for plugging a decorative lamp; the open ends of every two adjacent fastening bases face opposite direction; the two adjacent fastening bases are connected together with single arms. Each of the fastening bases of the figurative lamp-mounting frame enables one of the socket assemblies to be clicked in place. The front and rear sides of each bulb mounted on the lamp-mounting frame are exposed to the air so as to have the winking of every bulb shown to form a vivid figurative structure.

Another object of the present invention is to provide a figurative lamp-mounting frame, in which every fastening base for clamping a socket assembly has two arm plates; one side of the two arm plates are furnished with two symmetrical hooks; a positioning plate is furnished above the hooks and on one side of the arm plates; the inner surface of the positioning plate is furnished with a concave surface to fit to a curved surface of the socket. Another positioning plate is furnished under the hooks and on one side of the arm plates, and the inner surface of the positioning plate is furnished with two symmetrical flat surfaces and a concave surface for positioning the lower part of the socket. When a socket assembly is plugging into the open end of the fastening base on the lamp-mounting frame, the upper and lower parts of the socket will be in close contact with the inner surface of the positioning plate for positioning so as to have the socket clamped in place by means of the symmetrical hooks.

Still another object of the present invention is to provide a figurative lamp-mounting frame, in which the open ends of two adjacent fastening bases face different directions for receiving sockets respectively; the bulb on each socket is not covered, i.e., the winking light of each bulb can be shown from the front and rear sides thereof; the mounting condition of each socket assembly can be seen clearly from the front and rear sides of the lamp-mounting frame.

A further object of the present invention is to provide a figurative lamp-mounting frame, in which connection arm plates are furnished between two adjacent fastening bases; the connection arm plates arranged in parallel extend through all the fastening bases.

A still further object of the present invention is to provide a figurative lamp-mounting frame, in which the connection arm plates between two adjacent arm plates have a suitable decorative side extended there-from.

Yet another object of the present invention is to provide a figurative lamp-mounting frame, in which the open end of every fastening base has two symmetrical hooks, which have a given flexibility for clicking a socket therein; also, the socket can be plugged in through the space formed with the two symmetrical flat surfaces so as to have the symmetrical flat surfaces of the lower part of the socket fastened in the positioning groove, and then the curved surfaces of the hooks will hold the curved surface of the upper part of the socket so as to have the socket assembly fastened in place without moving out.

DETAILED DESCRIPTION OF THE PREFERRED EMBODIMENT

Figure 1:
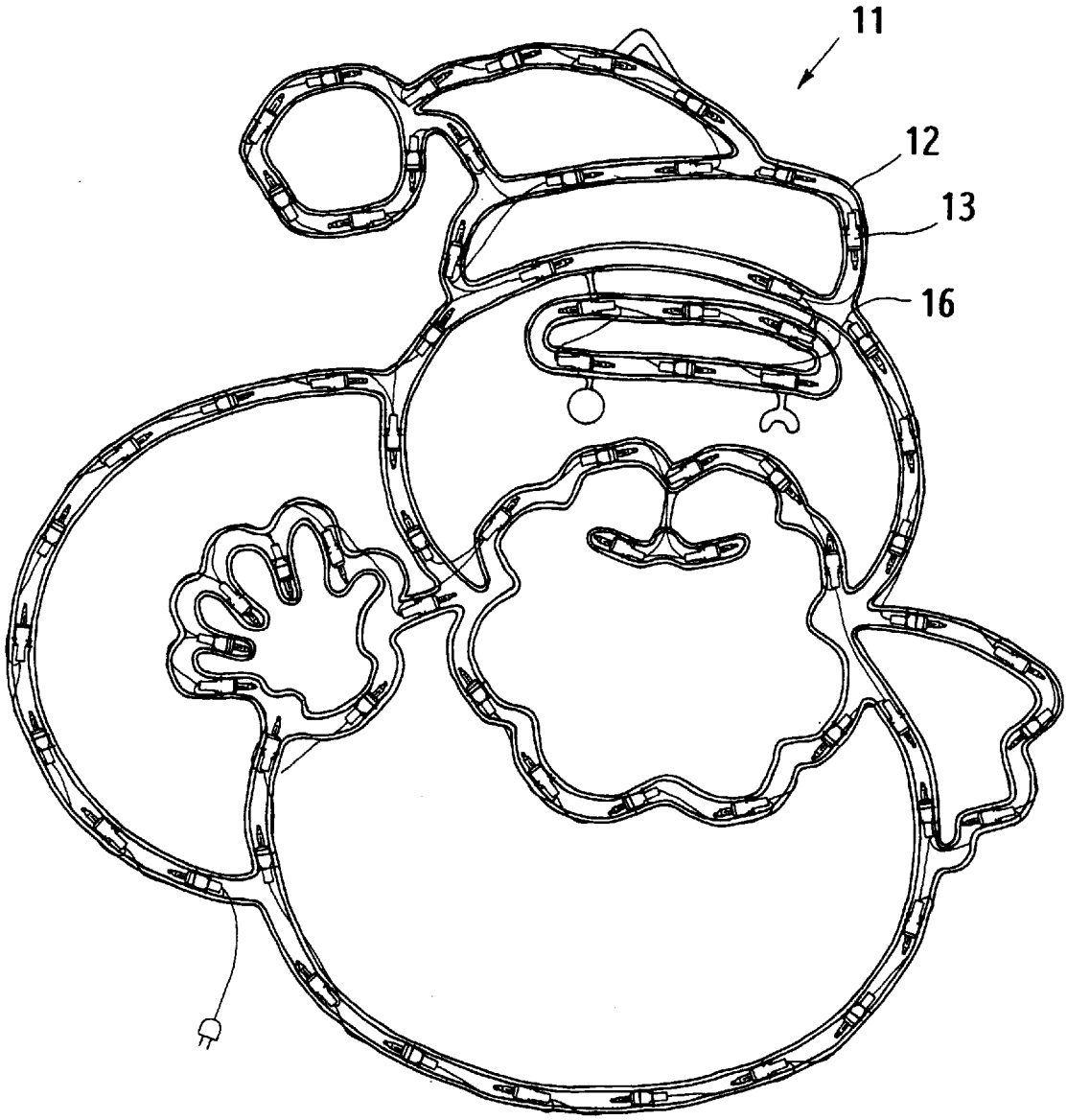
FIG. 1 is a plan view of the figurative structure for a decorative lamp string according to the present invention, showing the relation between the lamp frame and the lamp string.
Figure 2:
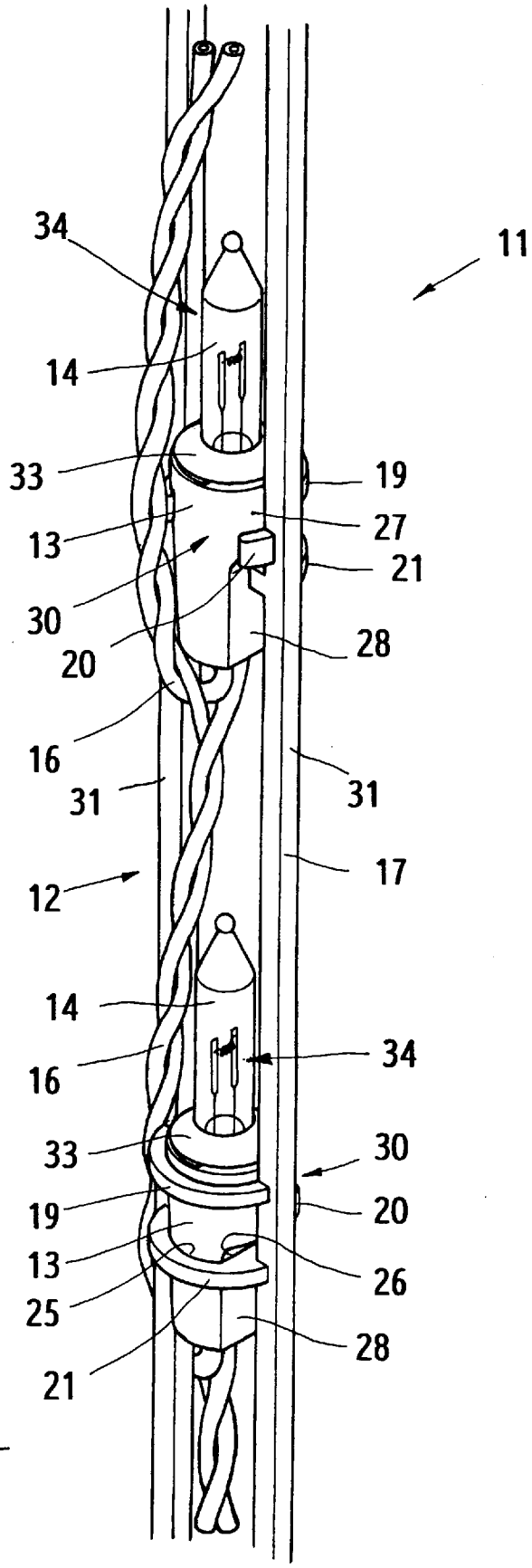
FIG. 2 is a perspective view of the present invention, showing the connection relation between the socket assembly and the lamp frame.

The figurative structure for mounting a decorative lamp string according to the present invention as shown in FIGS. 1 and 2 comprises mainly a figurative lamp-mounting frame 12, a plurality of fastening bases 18 mounted between two arm plates 17 at a regular distance one another, two open ends 30 of every two fastening bases 18 facing opposite directions so as to facilitate a socket assembly 13 to be pressed and mounted therein; the bulbs 14 in the sockets can be lit up as soon as the lamp string 11 is turned on with a power supply. Since both the front and rear sides of the lamp-mounting frame 12 are uncovered, the figurative structure can be shown clearly upon the lamps being lit up.

The lamp string 11 mounted to the fastening bases 18 of the lamp-mounting frame 12 includes two or more than two power wires 16 twisted together and a plurality of socket assemblies 13 mounted to the fastening bases 18 respectively; each lamp assembly 13 includes a socket 15 and a bulb 14. The outer surface 29 of the socket 15 has a slightly tapered shape. The lower portion of the outer surface 29 has two symmetrical flat surfaces 28. The lower end of the socket 15 is connected with two power wires 16. The upper end of the socket 15 is plugged with a bulb 14 mounted with a connection sleeve 33. Each socket 15 of the lamp string 11 is clicked into the fastening base 18 of the lamp-mounting frame 12. The power wires 16 are laid along the arm plates 17.

Figure 3:
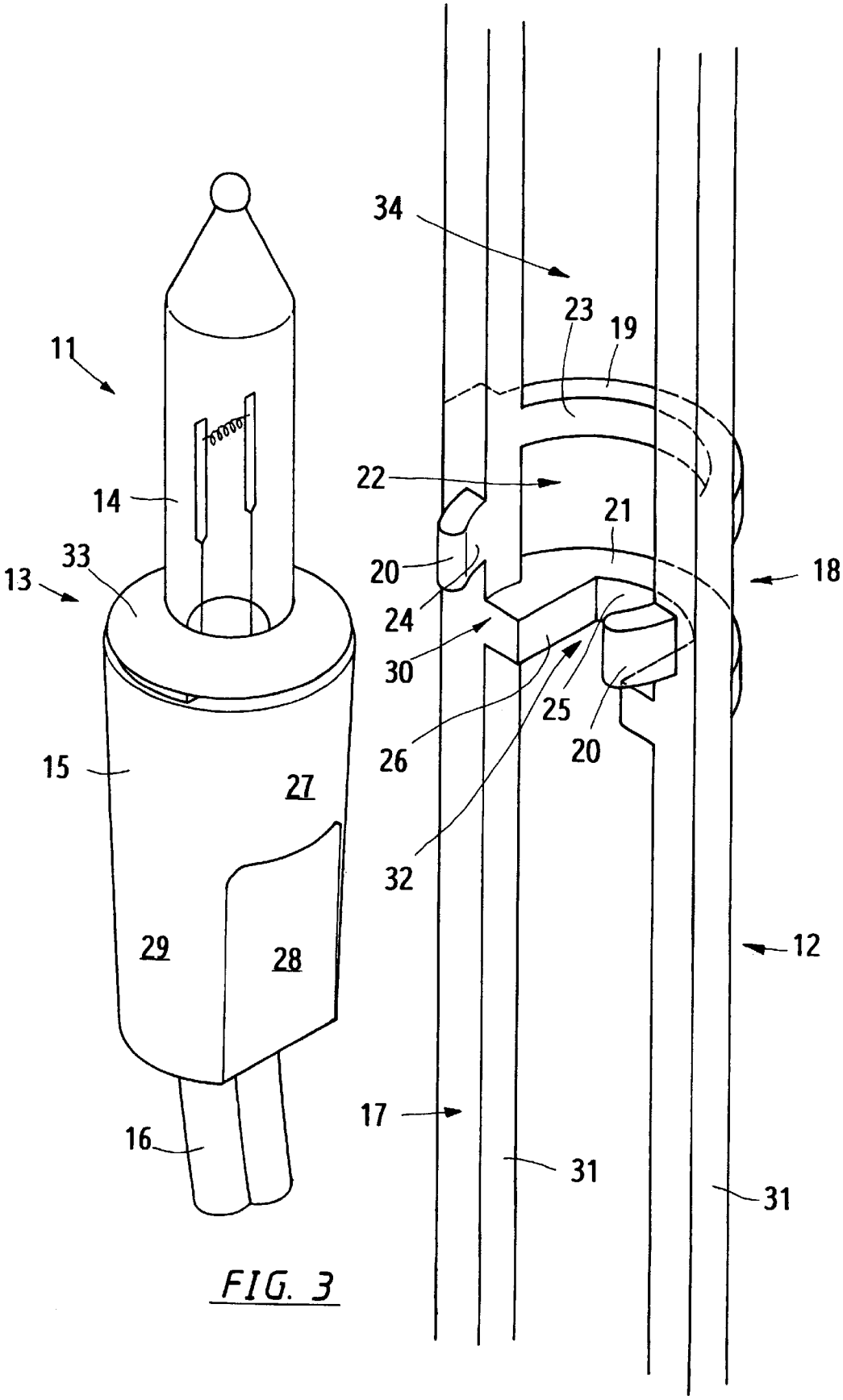
FIG. 3 is a perspective view of the present invention, showing an outer view upon the socket assembly mounted on the lamp frame.
Figure 4:
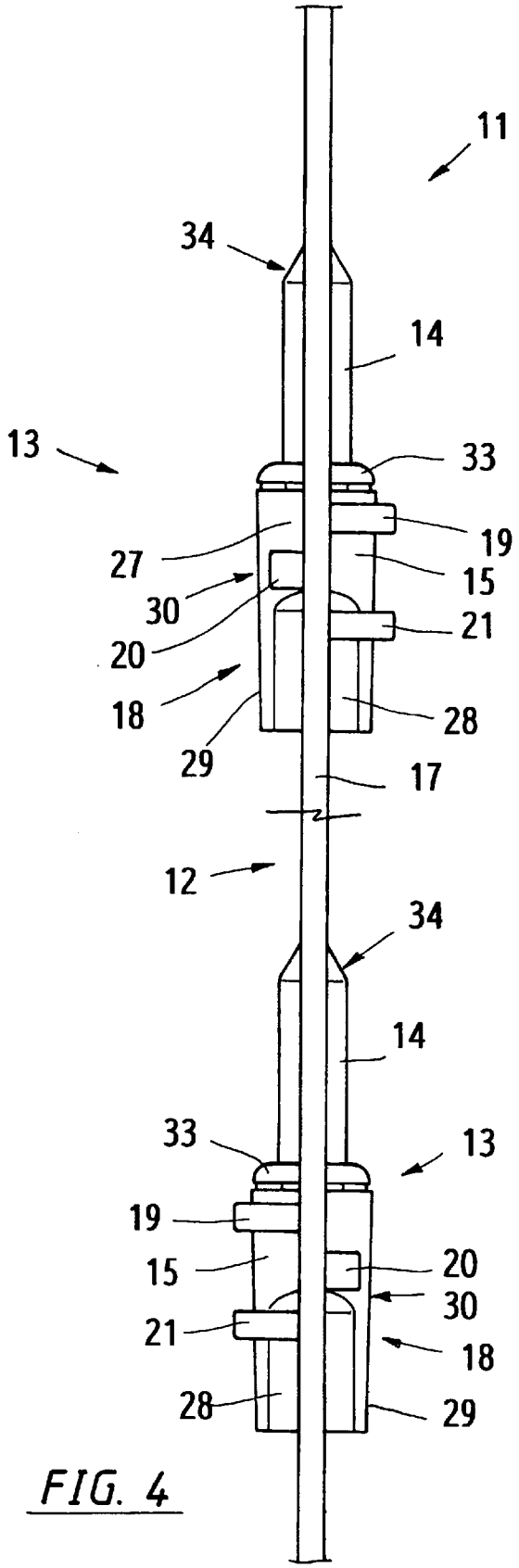
FIG. 4 is a plan view of the present invention, showing the socket assembly mounted on the lamp frame.

As shown in FIGS. 2 to 4, the figurative structure of the lamp-mounting frame 12 is formed by injection molding by using plastic material, and the figurative structure cam be formed into a person, or scenery of a given season by means of an outline thereof. The outline of the lamp-mounting frame 12 includes two arm plates 17 connected in parallel with a plurality of fastening bases 18; both sides of each fastening base 18 are furnished with two parallel single arms 31 respectively; The single arms 31 of the fastening bases 18 and the arm plates 17 are arranged in parallel and extended into a figurative structure of the lamp-mounting frame 12. The fastening bases 18 on the lamp-mounting frame 12 are arranged at a short distance from each other; every socket assembly 13 of the lamp string 11 is clicked into one fastening base 18 of the lamp-mounting frame 12. Both front and rear sides of each bulb 14 of the socket assembly 13 are exposed to transparent space; the twisted power wires 16 are attached to the outer side of the lamp-mounting frame 12; the fastening base 18 for mounting the socket assembly 13 is clamped between the positioning plates 19 and 21 without any cover. The socket 15 of the socket assembly 13 can be seen clearly from the front side or rear side of the lamp-mounting frame 12.

The open ends of every two adjacent fastening bases 18 are facing in opposite direction; each fastening base 18 includes two single arms 31, a positioning plate 21. Both single arms 31 of the fastening base 18 have a suitable thickness, and the space between the two single arms 31 is slightly larger than the maximum outer diameter of the socket 15. The front sides of the two single arms 31 are furnished with two symmetrical hooks 20 respectively; each hook 20 extends out of the outer surface of the single arm 31 at a given length. The inner surface of the hook 20 is a curved surface 24 so as to fit the curved surface 27 of the upper part of the socket 15. There is a distance between two ends of the two hooks 20, which is about equal to the thickness between the two symmetrical flat surfaces on the lower part of the socket 15 so as to form into an open end 30 between the two hooks 20, and to facilitate the socket assembly 13 to click therein. On the upper opposite side of the hook 20, there is a positioning plate 19 located between the two single arms 31 of the fastening base 18; the inner surface of the positioning plate 19 is substantially a concave surface 23, which is designed to fit the curved surface 27 on the socket 15. Between the two single arms 31 of the fastening base 18, there is a positioning plate 21 located under the hook 20; the inner surface of the positioning plate 21 is substantially a concave surface 25; both ends of the concave surface 25 extend outwards with two flat surfaces 26 respectively to the single arms 31. The distance between the two flat surfaces 26 is slightly larger than the thickness between the two symmetrical flat surfaces 28; the concave surface 25 and the two flat surfaces 26 are formed into positioning groove 32. The hollow space 22 formed by means of the positioning plate 19, the hooks 20, the positioning plate 21 and the single arms 31 is so designed as to fit the circular size of the socket 15 of the socket assembly 13 in order to let the socket assembly 13 click therein.

Each socket 15 of the lamp string 11 is to be clicked into the fastening base 18 by pushing the curved surface 27 of the socket 15 towards the open end 30 of the two hooks 20, or by pushing the symmetrical flat surfaces 28 under the socket towards the open end 30 of the two hooks 20, and then moving the socket assembly downwards so as to have the symmetrical flat surfaces 28 plugged into the positioning groove 32; then, the curved surface 27 of the socket 15 will be in close contact with the concave surface 23 of the positioning plate 19; the curved surface 24 of the hooks 20 will cover around the curved surface 27 on the upper part of the socket 15 so as to prevent the socket 15 from moving out. After the socket assembly 13 is fastened to the fastening base 18, the connection sleeve 33 attached to the bulb 14 will be located in a hollow portion 34 above the positioning plate 19; since the hollow portion 34 has no covering except the two arm plates 17, the bulb 14 can clearly and completely be shown on the front and rear sides of the lamp-mounting frame 12.

The open ends 30 of two adjacent fastening bases 18 in the lamp-mounting frame 12 are designed to face opposite direction respectively; every two fastening bases 18 are spaced at a short distance; two adjacent socket assemblies 13 are connected electrically with power wires 16. When the lamp string 11 and the lamp-mounting frame 12 are being assembled together, a plurality of socket assemblies 13 are mounted in the fastening bases 18 in one direction at a span of two socket assemblies 13, while another plurality of socket assemblies 13 are mounted in the fastening bases 18 in opposite direction. The power wires 16 of the lamp string 11 are laid in close contact with the arm plates 17 between two fastening bases 18 in accordance with the facing direction of the fastening bases 18.

The figurative lamp-mounting frame 12 according to the present invention has a plurality of open ends 30 on the fastening bases 18, and every two adjacent open ends 30 of the fastening bases 18 are mounted in opposite direction; one socket assembly 13 is clicked into one of the fastening bases 18; each socket assembly 13 is mounted in a hollow portion 22; one can see the lamp-mounting frame from the front or rear side thereof. Since only a portion of the socket assembly 13 is covered with the positioning plates 19 and 21 or the hooks 20, the figurative socket assembly 13 can be seen completely so as to provide a two-side decoration. A complete figurative structure by means of the socket assembly 13 can clearly be seen from the front or rear side of the two fastening bases 18 in the lamp-mounting frame 12; however; the open ends 30 of the hooks 20 of each fastening base 18 may face in one direction only. As soon as the power for the lamp string 11 is turned on, every bulb 14 of the socket assembly 13 will be lit up to show a figurative structure as designed.

According to the aforesaid description of the embodiment of the present invention, it is apparent that the features and structure of the present invention have been disclosed fully to show evident improvement of structure of the kind, and such features are never anticipated and shown by any person who is skilled in the field; therefore, the present invention is deemed unique.

What is claimed is:

1. A figurative structure for clamping a decorative lamp string having a plurality of lamp sockets, each socket having a taper-shaped outer surface, with a lower part having two symmetrical flat surfaces, an upper end of said socket engaged with a bulb, said figurative structure comprising:

a lamp-mounting frame with a plurality of spaced apart fastening bases, each fastening base having spaced arms: two open ended, spaced apart, adjacent positioning plates connecting the spaced arms, each adjacent pair of positioning plates opening in opposite directions, respectively; two symmetrical hooks extending from the spaced arms in directions opposite to the positioning plates, the two hooks being located between the associated, spaced apart positioning plates; a distance between said spaced arms being larger than a minimum outer diameter of said sockets; an inner side of each said hooks having a curved surface to fit a curved surface of said socket; ends of said two hooks being spaced apart an open distance approximately equal to a thickness between said two symmetrical flat surfaces on said socket; an inner surface of one of said two positioning plates having a concave surface to fit a curved surface on said socket, the other of said two positioning plates having two flat surfaces extending from a concave surface towards said spaced arms to form a positioning groove; a hollow portion being formed by said positioning plates said hooks, and said spaced arms so as to facilitate said sockets to be inserted into said open ends of said hooks, and said bulb of said socket assembly being positioned in said hollow portion above said fastening base.

2. A figurative structure for clamping a decorative lamp string as claimed in claim 1, wherein said spaced arms of said fastening base are parallel.

* * * * *